US011737560B2

(12) United States Patent
Satani et al.

(10) Patent No.: US 11,737,560 B2
(45) Date of Patent: Aug. 29, 2023

(54) SUPPORT PART, HOUSING STRUCTURE USING THE SAME, AND ITEM

(71) Applicant: FUJIFILM Business Innovation Corp., Tokyo (JP)

(72) Inventors: Maho Satani, Kanagawa (JP); Taisuke Endo, Kanagawa (JP); Toru Motosugi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/549,884

(22) Filed: Dec. 14, 2021

(65) Prior Publication Data

US 2023/0058679 A1 Feb. 23, 2023

(30) Foreign Application Priority Data

Aug. 23, 2021 (JP) ..... 2021-135473

(51) Int. Cl.
*A47B 91/00* (2006.01)
*A47B 91/02* (2006.01)
(Continued)

(52) U.S. Cl.
CPC ..... *A47B 91/005* (2013.01); *A47B 91/022* (2013.01); *A47B 91/12* (2013.01);
(Continued)

(58) Field of Classification Search
None
See application file for complete search history.

(56) References Cited

U.S. PATENT DOCUMENTS 2,680,326 A * 6/1954 Sultan ..... A47B 91/024 248/188.4
4,915,334 A * 4/1990 White ..... F16M 7/00 248/188.4

(Continued)

FOREIGN PATENT DOCUMENTS

| | | |
|---|---|---|
| JP | 2002252475 | 9/2002 |
| JP | 2003218544 | 7/2003 |
| JP | 2018011708 | 1/2018 |

*Primary Examiner* — Steven M Marsh
(74) *Attorney, Agent, or Firm* — JCIPRNET

(57) ABSTRACT

A support part that supports a lower portion of a housing upon installation of an item on an installation surface, includes: a leg part including an outer leg portion, an inner leg portion, and a connecting portion, the outer leg portion being provided so as to come into contact with the installation surface and extending from a gap between the lower portion of the housing and the installation surface so as to protrude outward of an outer side surface of the housing, the inner leg portion being disposed above the outer leg portion and extending inward of the outer side surface of the housing, the connecting portion connecting the outer leg portion and the inner leg portion inside the outer side surface of the housing; a raising/lowering section that is provided at the lower portion of the housing and that supports the inner leg portion of the leg part so as to raise and lower the inner leg portion; and an operation section that is provided so that a portion of the operation section protrudes outward of an outer side surface of the connecting portion of the leg part and that operates a raising/lowering movement of the raising/lowering section.

20 Claims, 11 Drawing Sheets

(51) Int. Cl.
*A47B 91/12* (2006.01)
*A47B 97/00* (2006.01)
*A47B 45/00* (2006.01)

(52) U.S. Cl.
CPC ..... *A47B 45/00* (2013.01); *A47B 97/00* (2013.01); *A47B 2220/0027* (2013.01)

(56) References Cited

U.S. PATENT DOCUMENTS

| | | | | |
|---|---|---|---|---|
| 5,697,586 | A * | 12/1997 | Lybarger | D06F 39/125 248/188.4 |
| 8,485,480 | B2 * | 7/2013 | Bove | A47B 91/024 248/188.4 |
| 8,777,025 | B1 * | 7/2014 | Buckleitner | D06F 57/12 211/205 |
| 9,074,809 | B2 * | 7/2015 | Lee | E05D 7/0423 |
| 9,416,483 | B1 * | 8/2016 | Freakes | F16M 7/00 |
| 2005/0172678 | A1 * | 8/2005 | Kim | A47B 91/005 68/3 R |
| 2006/0124810 | A1 * | 6/2006 | Cotto | A47B 91/024 248/188.4 |
| 2008/0116330 | A1 * | 5/2008 | Cotto | A47B 91/024 248/188.4 |
| 2012/0241568 | A1 * | 9/2012 | Christian | A47B 91/02 248/188.2 |

* cited by examiner

SUPPORT PART, HOUSING STRUCTURE USING THE SAME, AND ITEM

CROSS-REFERENCE TO RELATED APPLICATIONS

This application is based on and claims priority under 35 USC 119 from Japanese Patent Application No. 2021-135473 filed Aug. 23, 2021.

BACKGROUND

(i) Technical Field

The present disclosure relates to a support part to be used upon installation of an item, a housing structure using the support part, and an item.

(ii) Related Art

In general, upon installation of various items such as multifunction machines, home appliances, and furniture, support parts for preventing the items from falling down are used in some cases.

As support parts of this type in related art, for example, there are known support parts described in Japanese Unexamined Patent Application Publication No. 2002-252475 (Detailed Description, FIG. 1), hereinafter referred to as Patent Document 1, Japanese Unexamined Patent Application Publication No. 2003-218544 (Detailed Description, FIG. 1, FIG. 2), hereinafter referred to as Patent Document 2, and Japanese Unexamined Patent Application Publication No. 2018-11708 (Detailed Description, FIG. 1), hereinafter referred to as Patent Document 3.

Patent Document 1 discloses an overturn preventing device disposed at a bottom surface of an apparatus including leg portions on the bottom surface facing a floor surface, and discloses an aspect in which the overturn preventing device includes overturn preventing members provided to be rotatable about support shafts of the leg portions or support shafts provided between the leg portions.

Patent Document 2 discloses an overturn preventing mechanism provided at a table on which an image forming apparatus is mounted or at an image forming apparatus component such as a sheet feeding device, and discloses an aspect in which overturn preventing members are provided so as to be housed at a lower surface of the table or the component.

Patent Document 3 discloses an overturn preventing device including fixing leg portions that are installed at positions farther from a floor surface than attachment positions of moving wheels, at four corners at which the moving wheels are attached to a bottom surface of an apparatus whose overturn is to be prevented, the height of the fixing leg portions being adjustable.

SUMMARY

Aspects of non-limiting embodiments of the present disclosure relate to enabling a support part to be used upon installation of an item to stably support the item by suppressing a situation in which the support part obstructs passage when the item is installed, and to easily retract the support part upward when the item is moved, as compared with a case where the entire support part protrudes from an outer side surface of a housing.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a support part that supports a lower portion of a housing upon installation of an item on an installation surface, including: a leg part including an outer leg portion, an inner leg portion, and a connecting portion, the outer leg portion being provided so as to come into contact with the installation surface and extending from a gap between the lower portion of the housing and the installation surface so as to protrude outward of an outer side surface of the housing, the inner leg portion being disposed above the outer leg portion and extending inward of the outer side surface of the housing, the connecting portion connecting the outer leg portion and the inner leg portion inside the outer side surface of the housing; a raising/lowering section that is provided at the lower portion of the housing and that supports the inner leg portion of the leg part so as to raise and lower the inner leg portion; and an operation section that is provided so that a portion of the operation section protrudes outward of an outer side surface of the connecting portion of the leg part and that operates a raising/lowering movement of the raising/lowering section.

BRIEF DESCRIPTION OF THE DRAWINGS

Exemplary embodiments of the present disclosure will be described in detail based on the following figures, wherein.

DETAILED DESCRIPTION

Outline of Exemplary Embodiment

Figure 1A:
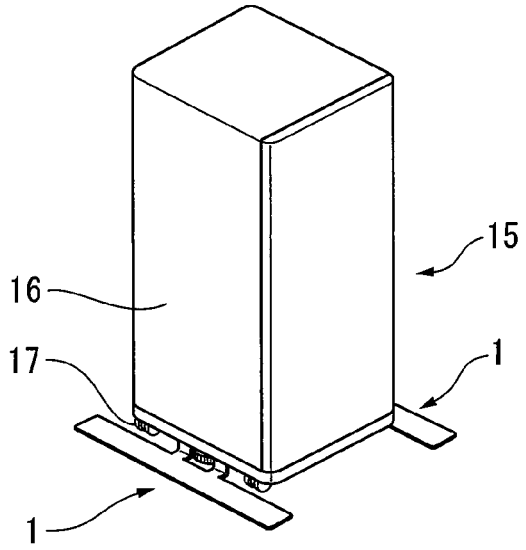
FIG. 1A is an explanatory view illustrating an outline of an exemplary embodiment of an item having a housing structure including a support part to which the present disclosure is applied.

FIG. 1A illustrates an outline of an exemplary embodiment of an item having a housing structure including a support part to which the present disclosure is applied.

In the drawing, an item 15 includes a housing structure including a housing 16 and a support part 1 provided at a lower portion of the housing 16, and various item elements (not illustrated) are mounted on the housing structure.

The item 15 referred to herein widely includes products such as multifunction machines having functions of a copying machine, a printer, a scanner, a facsimile, and so forth, home electric appliances, and furniture, and is effective for items that tend to be unstable, such as items having a high position of the center of gravity and items having a vertical housing with a large height dimension in spite of a small installation area.

Figure 1B:
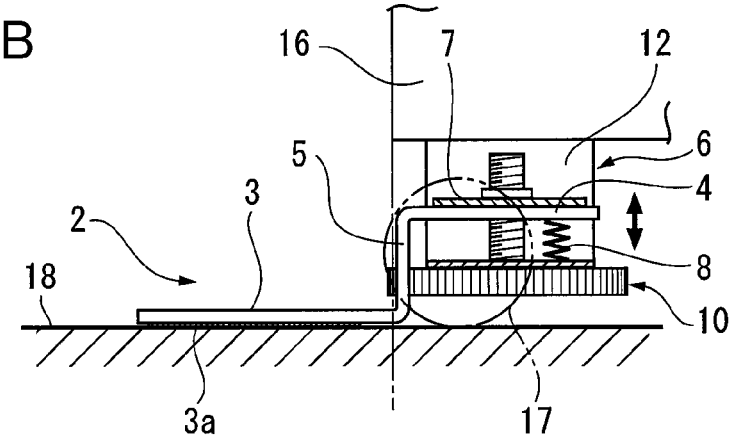
FIG. 1B is an explanatory view illustrating a state of the support part when the item is installed.
Figure 1C:
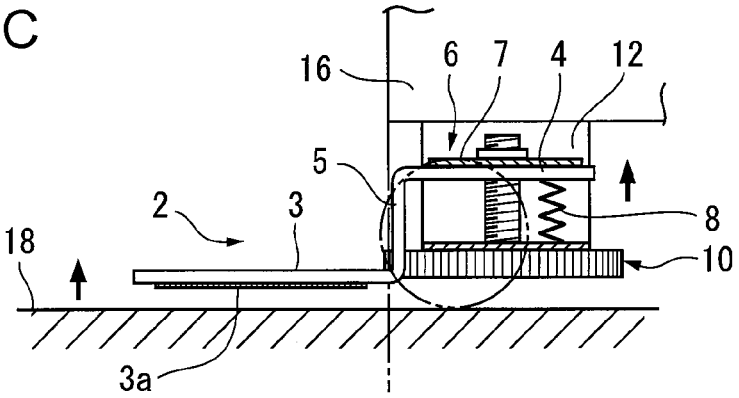
FIG. 1C is an explanatory view illustrating an upward retracted state of the support part when the item is moved.

In this example, as illustrated in FIGS. 1A to 1C, the support part 1 supports a lower portion of the housing 16 upon installation of the item 15 on an installation surface 18, and includes a leg part 2, a raising/lowering section 6, and an operation section 10. The leg part 2 includes an outer leg portion 3, an inner leg portion 4, and a connecting portion 5. The outer leg portion 3 is provided so as to come into contact with the installation surface 18 and extends from a gap between the lower portion of the housing 16 and the installation surface 18 so as to protrude outward of an outer side surface of the housing 16. The inner leg portion 4 is disposed above the outer leg portion 3 and extends inward of the outer side surface of the housing 16. The connecting portion 5 connects the outer leg portion 3 and the inner leg portion 4 inside the outer side surface of the housing 16. The raising/lowering section 6 is provided at the lower portion of the housing 16 and supports the inner leg portion 4 of the leg part 2 so as to raise and lower the inner leg portion 4. The operation section 10 is provided so that a portion thereof protrudes outward of an outer side surface of the connecting portion 5 of the leg part 2 and operates a raising/lowering movement of the raising/lowering section 6.

In such technical measures, although the housing structure widely includes a structure supported by the support part 1, it is desirable that the housing structure includes multiple movable casters 17 provided at a lower portion of the housing 16 as illustrated in FIG. 1A from the viewpoint of improving movability and transportability of the item 15. An aspect is desirable in which the lower portion of the housing 16 at which the support part 1 is provided is different from support points of the multiple casters 17 from the viewpoint of improving attachment workability of the support part 1.

In an aspect in which an operation unit (not illustrated) for an item element (not illustrated) is provided at an upper portion of the housing 16, an aspect is desirable in which the support part 1 does not obstruct an operation of the operation unit by a user. From the viewpoint, an aspect is desirable in which the support part 1 is provided so as to face a region of the housing 16 other than a region where the user works on the operation unit.

The support part 1 may be any part as long as it is intended to stably install the item 15 such as to prevent the item 15 from falling down, to adjust the height, and to hold the item 15 horizontally.

As the number of support parts 1 to be installed, in a case of an item 15 whose position of the center of gravity is biased to one side, for example, one or multiple support parts 1 may be provided on one side of the housing 16 on the side where the position of the center of gravity is biased, and the support parts 1 may be provided symmetrically with respect to the housing 16 to stably support the item 15.

The leg part 2 may be any part as long as the part includes the outer leg portion 3 protruding outward of the outer side surface position of the housing 16 from the gap between the lower portion of the housing 16 and the installation surface 18 with reference to the outer side surface position of the housing 16, and the inner leg portion 4 and the connecting portion 5 disposed in the gap inside of the outer side surface position of the housing 16.

The outer leg portion 3 extends in a flat plate shape; however, the outer leg portion 3 may have a bent portion in which a portion thereof is bent upward or a step portion. The inner leg portion 4 extends in a flat plate shape; however, the inner leg portion 4 may have a protruding and recessed portion or a flange portion for enhancing surface rigidity in a portion thereof. The connecting portion 5 connects the outer leg portion 3 and the inner leg portion 4, and may have a flat plate shape, or may be appropriately changed in design into such as a columnar shape by adding a reinforcing member to the flat plate shape. The arrangement posture of the connecting portion 5 is not limited to the vertical direction, and may be slightly inclined, and boundary portions between the connecting portion 5 and the outer leg portion 3 and between the connecting portion 5 and the inner leg portion 4 are connected in a bent shape or a curved shape.

In this example, the outer side surface of the housing 16 refers to an outer side surface of an exterior member in a portion having the exterior member, and refers to an outer side surface of a housing frame that constitutes a framework of the housing 16 in a portion not having the exterior member.

In this example, by employing a structure in which only the outer leg portion 3 protrudes from the outer side surface of the housing 16, it is possible to suppress an occupied region in the up-down direction viewed from a lateral side of the support part 1 protruding from the outer side surface of the housing 16.

In contrast, in an aspect in which the support part entirely protrudes from the outer side surface of the housing 16, there is a concern that the support part may obstruct passage. In an aspect in which the support part is entirely housed at the lower portion of the housing 16, there is no concern that the support part obstructs passage. However, for the item 15 having a vertical housing with a small installation area and a large height dimension, the position of the center of gravity is high and the distance from the position of the center of gravity to the support part is small, and hence the item 15 is likely to fall down.

As the raising/lowering section 6, a raising/lowering principle or the like may be appropriately selected as long as the raising/lowering section 6 raises and lowers the inner leg portion 4. Since the inner leg portion 4 is located above the outer leg portion 3, since the lower region of the inner leg portion 4 is easily effectively utilized as an installation space for the raising/lowering section 6, and since the inner leg portion 4 may be disposed in a posture orthogonal to a movement direction of the rising/lowering element as compared with the connecting portion 5, it is effective for stabilizing the raising/lowering movement. Thus, the inner leg portion 4 is a target related to the rising/lowering element instead of the outer leg portion 3.

As the operation section 10, a rotational operation system is typical. The operation section 10 may be an operation handle that is rotationally operable at a fixed position in a raising/lowering direction, or may be an operation handle that rises and lowers together with the inner leg portion 4. The operation section 10 is not limited to the rotational operation system, and, for example, a lever operation system capable of swinging or moving along a predetermined locus may be employed.

Next, aspects of the support part 1 according to the present exemplary embodiment will be described.

First, as an aspect of the leg part 2, an aspect is exemplified in which a length dimension of the outer leg portion 3 in a direction along the outer side surface of the housing 16 is larger than that of the inner leg portion 4. The outer leg portion 3 is a portion that comes into contact with the installation surface 18, and is effective for securing a wide installation area from the viewpoint of stably supporting the item 15.

In particular, an aspect is desirable in which the length dimension of the outer leg portion 3 in the direction along the outer side surface of the housing 16 is larger than or equal to a horizontal-direction dimension of the outer side surface of the housing 16. This example is an aspect in which the installation area of the outer leg portion 3 is secured over the entire horizontal-direction dimension of the outer side surface of the housing 16. It is possible to sufficiently secure the installation area of the outer leg portion 3 even when the width-direction dimension intersecting the length direction of the outer leg portion 3 is decreased.

As an aspect of the outer leg portion 3, there is exemplified an aspect including a plate-shaped elastic member 3*a* on a bottom surface thereof. The elastic member 3*a* is effective for securing the contact state between the bottom surface of the outer leg portion 3 and the installation surface 18 by elastic deformation, and may be provided continuously or intermittently in the length direction of the outer leg portion 3.

As another aspect of the leg part 2, an aspect is exemplified in which the outer leg portion 3, the inner leg portion 4, and the connecting portion 5 are formed by bending a metal plate member formed in a predetermined shape. Since the leg part 2 of this example has a shape in which the outer leg portion 3 and the inner leg portion 4 are three dimensionally bent via the connecting portion 5, it is possible to easily manufacture the leg part 2 by bending a metal plate member that has been die-cut.

As the leg part 2, a frame member having a thickness larger than that of a frame member that constitutes the housing 16 may be used. For example, the frame member may be 2 mm thick and the leg part 2 may be 4 mm thick. However, without being limited to the aspect in which the leg part 2 is thicker than the frame member of the housing 16, of course, frame members having the same thickness may be used. In the case where the frame members having the same thickness are used as described above, the leg part 2 is easily procured, and the leg part 2 may be provided at a low cost accordingly.

The operation section 10 is required to be disposed so as to partially protrude outward of the outer side surface of the connecting portion 5 of the leg part 2. Hence, as a layout in which the operation section 10 and the connecting portion 5 do not interfere with each other, an aspect is exemplified in which the connecting portion 5 has an opening through which a portion of the operation section 10 is exposed.

As an aspect of the raising/lowering section 6, an aspect is exemplified in which the raising/lowering section 6 includes a rising/lowering element 7 that rises and lowers in conjunction with an operation of the operation section 10, and raises and lowers the inner leg portion 4 following the rising/lowering element 7. This example uses a system in which the inner leg portion 4 is raised and lowered indirectly via the rising/lowering element 7. The raising/lowering section 6 including the rising/lowering element 7 that moves in conjunction with the operation of the operation section 10 may be configured in a state separate from the leg part 2, and the raising/lowering section 6 and the leg part 2 may be assembled when the support part 1 is manufactured.

In this aspect, as an aspect of the raising/lowering section 6, an aspect is exemplified in which the inner leg portion 4 is disposed at a lower surface of the rising/lowering element 7, and the raising/lowering section 6 includes an urging element 8 that urges the inner leg portion 4 toward the rising/lowering element 7. In this example, the urging element 8 in a compressed and deformed state expands in accordance with rising of the rising/lowering element 7 and urges the inner leg portion 4 toward the rising/lowering element 7, and hence the inner leg portion 4 is raised following the rising of the rising/lowering element 7.

In FIGS. 1B and 1C, reference numeral 12 denotes a fixing bracket that is provided at the lower portion of the housing 16 and into which the raising/lowering section 6 and the operation section 10 are assembled.

In this aspect, as an aspect of the raising/lowering section 6, there is exemplified an aspect including a guide element that causes the rising/lowering element 7 to rise and lower in a rotation-inhibited state. In this example, for example, in a case where the operation section 10 is of the rotational operation system, a rotational operation force from the operation section 10 acts on the rising/lowering element 7. If the rising/lowering element 7 is rotated in conjunction with the operation section 10, the rising/lowering element 7 idles and is no longer raised and lowered. Hence, in this example, the guide element guides the rising/lowering element 7 so as to perform a raising/lowering movement in the rotation-inhibited state.

As an aspect of the operation section 10, an aspect is exemplified in which the connecting portion 5 has an opening, and the operation section 10 is present both outside and inside the connecting portion 5 across the opening. As an aspect of this example, there is an aspect in which the operation section 10 includes an operation portion and a shaft that rotates in accordance with an operation of the operation portion, the shaft is located inside the connecting portion 5, an outer periphery of the operation portion is located outside the connecting portion 5, and the operation section 10 is rotated by operating the outer periphery of the operation portion around the shaft.

As an aspect of the operation section 10, an aspect is exemplified in which the operation section 10 is rotatably provided at a fixed position. As a method of implementing this example, for example, the raising/lowering section 6 may have a threaded hole into which an external thread portion is screwed, and may include a rising/lowering element that rises and lowers in conjunction with an operation of the operation section 10.

First Exemplary Embodiment

Hereinafter, the present disclosure will be described in more detail based on an exemplary embodiment illustrated in the accompanying drawings.

Figure 2B:
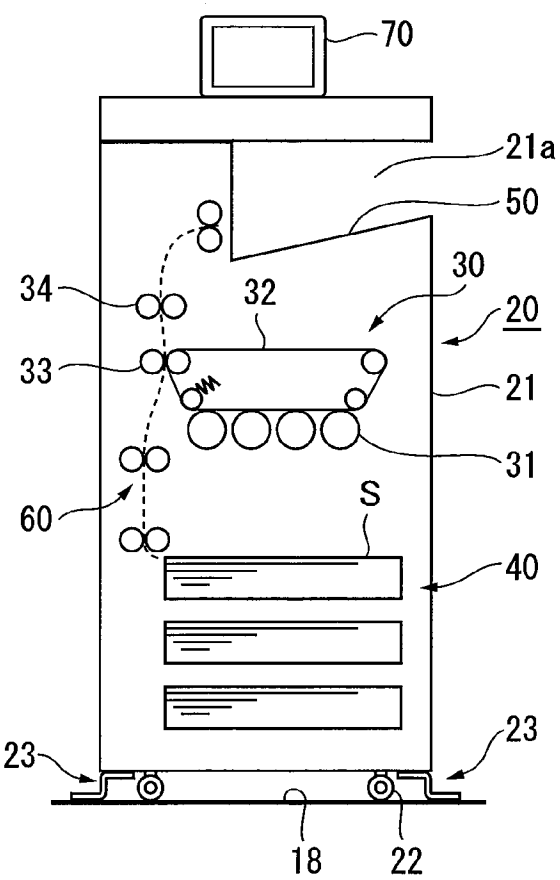
FIG. 2B is an explanatory view illustrating an outline of an overall configuration of the image forming apparatus illustrated in FIG. 2A.
Figure 2A:
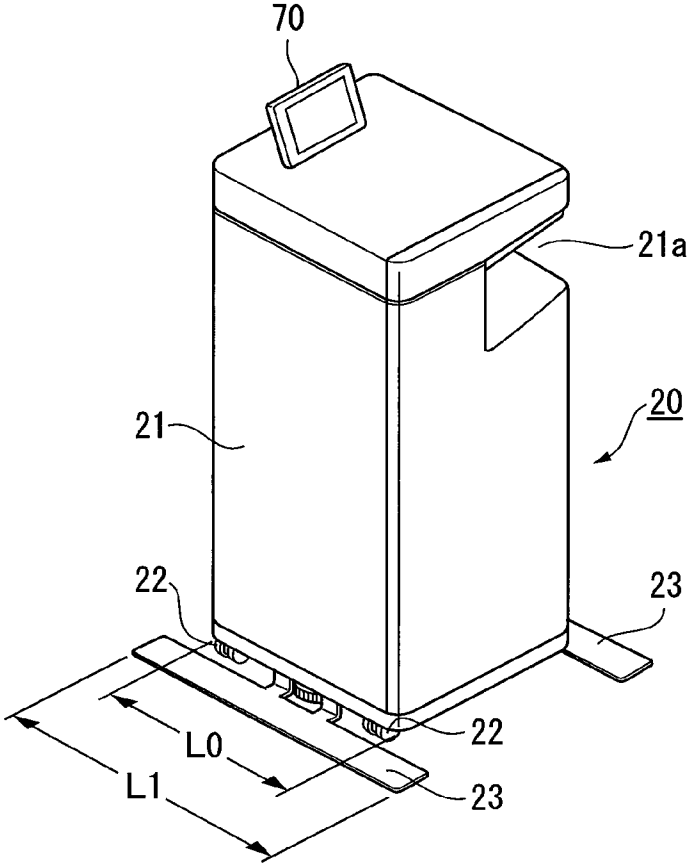
FIG. 2A is an explanatory view illustrating an appearance of an image forming apparatus as an item according to a first exemplary embodiment.

FIG. 2A illustrates an overall configuration of an image forming apparatus as an item according to a first exemplary embodiment.

Overall Configuration of Image Forming Apparatus

In the drawing, an image forming apparatus 20 includes a housing structure including an apparatus housing 21, multiple casters 22 that are provided at four corners of a lower portion of the apparatus housing 21 and that movably transport the apparatus housing 21, and a support part 23 that stably supports the apparatus housing 21 when the image forming apparatus 20 is installed. Elements required for image formation are mounted on the housing structure, as various item elements.

In this example, the apparatus housing 21 is configured in a vertically long substantially rectangular-parallelepiped shape, and has a shape having a recess 21*a* close to a top portion of one side surface (right side surface in the drawing) adjacent to a near side when a user operation side is considered as the near side.

In this example, as illustrated in FIG. 2B for example, the elements required for image formation include an image forming engine 30, a medium feed device 40, a medium discharge receiver 50, a medium transport system 60, and an operation panel 70. The image forming engine 30 is mounted in an upper region in the apparatus housing 21 and forms an image on a medium S such as paper. The medium feed device 40 is mounted in a lower region in the apparatus housing 21 and feeds a medium S such as paper toward the image forming engine 30. The medium discharge receiver 50 is provided using the recess 21*a* of the apparatus housing 21, and a medium S after an image is formed by the image forming engine 30 is discharged to and housed in the medium discharge receiver 50. The medium transport system 60 transports a medium S fed from the medium feed device 40 through the image forming engine 30 to the medium discharge receiver 50. The operation panel 70 is provided at a top portion of the apparatus housing 21 and performs an operation required for image formation on a control device (not illustrated) that controls the image forming engine 30, the medium feed device 40, and the medium transport system 60.

In this example, the image forming engine 30 includes multiple image forming sections 31 that form multiple color component images on multiple photoreceptors by, for example, an electrophotographic system, a belt-shaped intermediate transfer body 32 on which the color component images of the respective image forming sections 31 are first transferred and that transports the color component images, a transfer device 33 that transfers the first transferred images on the intermediate transfer body 32 onto a medium S, and a fixing device 34 that fixes the images transferred on the medium S. However, of course, the image forming engine 30 is not limited thereto.

In this example, the medium feed device 40 includes three medium feed sections. However, the number, layout, and so forth of the medium feed sections may be appropriately changed in design, and a manual medium feed section may be added as required.

The medium discharge receiver 50 may be appropriately changed in design according to the discharge position of a medium S. In this example, a transport method of forming an image on one side of a medium S is employed for the medium transport system 60. However, an image may be formed on both sides of a medium S by adding, for example, a double-sided transport module.

Overall Configuration of Support Part

Figure 3:
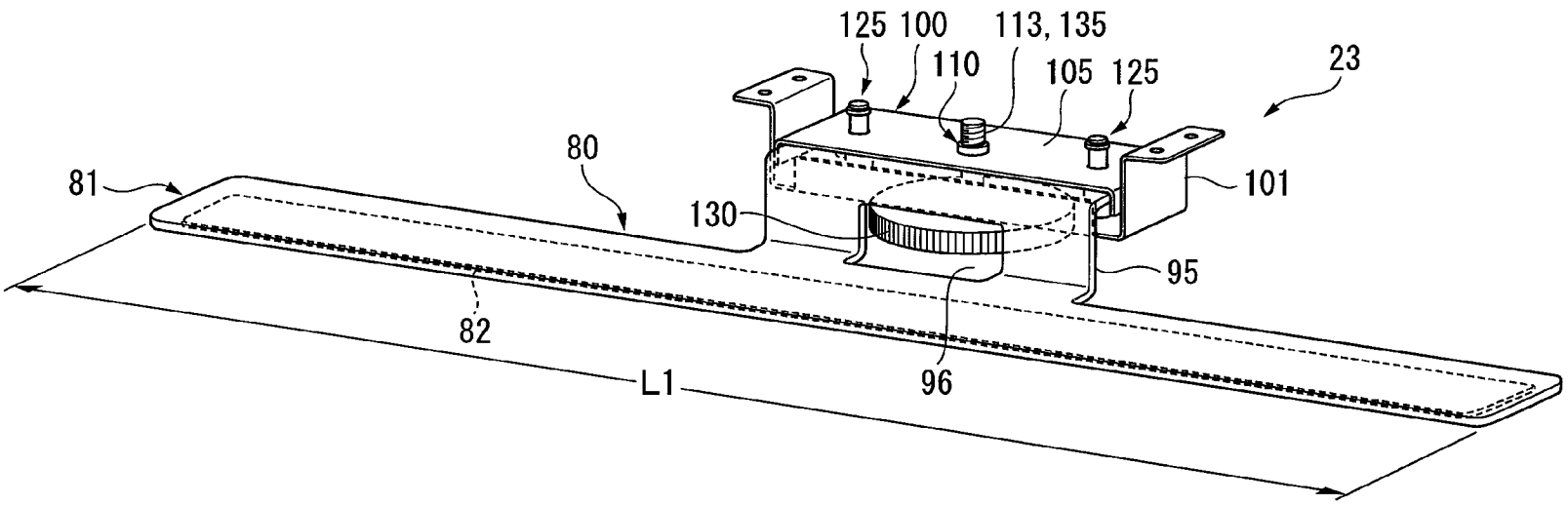
FIG. 3 is a perspective view illustrating an overall configuration of a support part used in the first exemplary embodiment.

In this example, the image forming apparatus 20 has a position of the center of gravity close to substantially the center of the apparatus housing 21 in plan view. As illustrated in FIGS. 2A, 2B, and 3, support parts 23 are symmetrically provided at lower portions on lateral sides (corresponding to sides) adjacent to a near side (corresponding to a front side) of the apparatus housing 21. The basic configuration of each of the support parts 23 includes a leg part 80, a raising/lowering mechanism 100, and an operation handle 130. The leg part 80 comes into contact with the installation surface 18 and supports the apparatus housing 21. The raising/lowering mechanism 100 is provided at a lower portion of the apparatus housing 21 and serves as a raising/lowering section that raises and lowers the leg part 80. The operation handle 130 serves as an operation section that operates a raising/lowering movement of the raising/lowering mechanism 100.

Leg Part

Figure 4:
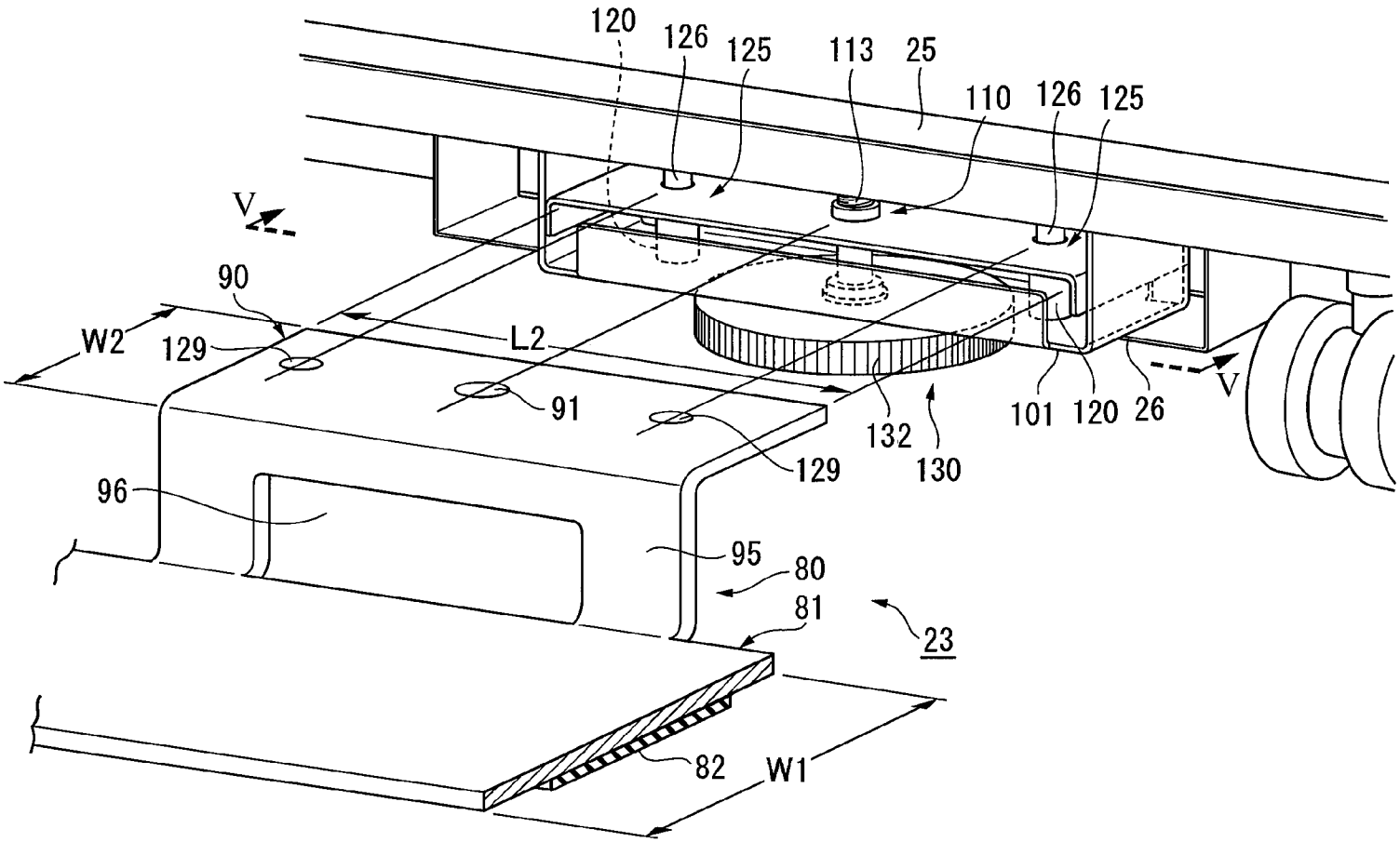
FIG. 4 is an explanatory view illustrating in detail the vicinity of a raising/lowering operation portion of the support part illustrated in FIG. 3.

In this example, as illustrated in FIGS. 3 and 4, the leg part 80 includes an outer leg portion 81, an inner leg portion 90, and a connecting portion 95. The outer leg portion 81 is provided so as to come into contact with the installation surface 18 and extends from a gap between the lower portion of the apparatus housing 21 and the installation surface 18 so as to protrude outward of an outer side surface of the apparatus housing 21. The inner leg portion 90 is disposed above the outer leg portion 81 and extends inward of the outer side surface of the apparatus housing 21. The connecting portion 95 connects the outer leg portion 81 and the inner leg portion 90 inside the outer side surface of the apparatus housing 21.

In this example, the leg part 80 is formed by bending a metal plate member to form the outer leg portion 81, the inner leg portion 90, and the connecting portion 95.

The metal plate member to be used as the leg part 80 may be appropriately selected as long as the metal plate member has rigidity required for supporting the image forming apparatus 20. However, in this example, the leg part 80 having a thickness t1 (see FIG. 7B) that is larger than a thickness of a frame member 25 that constitutes a frame of the apparatus housing 21 is selected. In general, the frame member 25 is often made of a plate member such as steel use stainless (SUS) having a thickness of 2 mm or smaller. In this example, the leg part 80 is made of, for example, a metal plate member having a thickness of 4 mm that is larger than the thickness of the frame member 25.

Outer Leg Portion

In this example, as illustrated in FIGS. 2A to 4, the outer leg portion 81 is made of an elongated rectangular plate member extending in a direction along the outer side surface on the lateral side (side) of the apparatus housing 21. A length dimension L1 of the outer leg portion 81 is larger than that of the inner leg portion 90 and is larger than or equal to a length dimension L0 (in this example, larger than L0) in the horizontal direction of the outer side surface on the lateral side of the apparatus housing 21.

A width dimension W1 of the outer leg portion 81 protruding outward from the outer side surface on the lateral side of the apparatus housing 21 is selected in consideration of the installation area including the leg part 80 with respect to the height of the apparatus housing 21 and based on the relationship with the length dimension L1 of the outer leg portion 81.

In order to prevent the leg part 80 from damaging the installation surface 18, an elongated rectangular elastic member 82 is attached to a back surface of the outer leg portion 81 so as not to protrude to a peripheral edge of the outer leg portion 81. Although depending on the weight of the image forming apparatus 20, an elastic rubber (for example, Poron rubber or the like) having a high hardness is used as the elastic member 82 when a certain heavy weight is assumed. From the viewpoint that there is a concern that the outer leg portion 81 may obstruct passage if the thickness of the elastic member 82 is too large, it is desirable that the thickness of the elastic member 82 is selected to be about 2 mm.

Inner Leg Portion

In this example, as illustrated in FIGS. 3 and 4, the inner leg portion 90 is formed of a rectangular plate member extending in a direction along the outer side surface on the lateral side (side) of the apparatus housing 21, has a length dimension L2 of about ⅓ of the length dimension L0 in the horizontal direction of the outer side surface on the lateral side of the apparatus housing 21, and is disposed near the center in the front-rear direction of the outer side surface on the lateral side of the apparatus housing 21. In this example, a width dimension W2 of the inner leg portion 90 extending inward from the outer side surface on the lateral side of the apparatus housing 21 may be appropriately selected. However, in this example, the width dimension W2 is slightly smaller than the width dimension W1 of the outer leg portion 81.

Since a load applied to the image forming apparatus 20 is exerted on the inner leg portion 90 and transferred from the inner leg portion 90 to the leg part 80, if the size of the inner leg portion 90 is too small, a large load stress acts on the inner leg portion 90 and the connecting portion 95, and hence it is required to sufficiently secure the rigidity of the inner leg portion 90 and the connecting portion 95 accordingly. In contrast, if the size of the inner leg portion 90 is appropriately selected based on arrangement of surrounding components, the load stress acting on the inner leg portion 90 and the connecting portion 95 may be decreased, and the strength of the inner leg portion 90 and the connecting portion 95 may be easily designed accordingly.

Connecting Portion

In this example, the connecting portion 95 is made of a rectangular plate member extending in substantially the vertical direction, and has a length dimension similar to the length dimension L2 of the inner leg portion 90. As the dimensions in the up-down direction of the outer leg portion 81 and the inner leg portion 90, the dimensions may be set to a value larger than the sum of the thickness of the operation handle 130 and the amount of upward retraction of the leg part 80 when the image forming apparatus 20 is transported.

In this example, the connecting portion 95 is connected to the outer leg portion 81 and the inner leg portion 90 at curved bent portions at boundary portions with respect to the outer leg portion 81 and the inner leg portion 90.

A rectangular opening 96 through which a portion of the operation handle 130 is allowed to be exposed is formed in the connecting portion 95, so that the leg part 80 and the operation handle 130 do not interfere with each other when the leg part 80 is raised or lowered.

Attached Portion Structure of Raising/Lowering Mechanism and Operation Handle

In this example, the raising/lowering mechanism 100 and the operation handle 130 are assembled to the lower side of the frame member 25 that constitutes the bottom portion of the apparatus housing 21. Both end flange portions of a fixing bracket 101 having a substantially hat-shaped cross section are fixed to a lower surface of the frame member 25 that constitutes the bottom portion of the apparatus housing 21 in a direction along the outer side surface on the lateral side of the apparatus housing 21 (corresponding to the front-rear direction of the apparatus housing 21) via fasteners 104 such as screws, and are used for assembling the raising/lowering mechanism 100 and the operation handle 130.

The fixing bracket 101 is formed in a size capable of housing the inner leg portion 90 of the leg part 80 in a non-contact state in an inner region thereof. The fixing bracket 101 has bent flanges 103 rising upward and formed on both side edges in the left-right direction intersecting with the front-rear direction of the apparatus housing 21 of a rectangular bottom wall 102 to increase surface rigidity of the bottom wall 102 of the fixing bracket 101.

In this example, in order to further increase the rigidity of the bottom portion of the apparatus housing 21 in the vicinity of the fixing bracket 101, a frame reinforcing member 26 having a wide channel-shaped cross section is fixed by welding to a lower surface of the frame member 25 so as to surround the fixing bracket 101. An outer surface of the bottom wall 102 of the fixing bracket 101 is disposed in contact with an inner surface of a bottom wall of the frame reinforcing member 26.

Operation Handle

In this example, as illustrated in FIGS. 3 to 6, the operation handle 130 has a disk-shaped handle body 131 integrally molded using, for example, polycarbonate (PC) resin or acrylonitrile butadiene styrene (ABS) resin. A serrated portion 132 is formed on an outer peripheral portion of the handle body 131 for preventing slipping during a rotational operation. A cylindrical stepped portion 133 is formed at the center of one surface of the handle body 131 and protrudes in the thickness direction of the handle body 131. A bottomed pin insertion hole 134 is formed on the stepped portion 133 side at the center of the handle body 131. One end of a metal shaft pin 135 serving as a rotation center shaft is housed in the pin insertion hole 134. The shaft pin 135 is inserted into the pin insertion hole 134, and one end portion of the shaft pin 135 is fixed to a bottom portion of the pin insertion hole 134 using a fastener 136 at the back side of the handle body 131. An external thread portion 113 is formed in a region close to a tip end of the shaft pin 135.

In this example, a holding hole 137 into which the stepped portion 133 of the operation handle 130 may be inserted is formed in bottom walls of the fixing bracket 101 and the frame reinforcing member 26. The operation handle 130 causes the holding hole 137 of the fixing bracket 101 to rotatably hold the stepped portion 133, causes the shaft pin 135 to be disposed in the fixing bracket 101, and causes the shaft pin 135 to engage with the raising/lowering mechanism 100 as described later. Thus, the handle body 131 is rotatably held at a fixed position on the lower surface of the frame reinforcing member 26.

In this state, the handle body 131 of the operation handle 130 is disposed so as to be exposed to the outside of the apparatus housing 21 from the opening 96 formed in the connecting portion 95 of the leg part 80. A protruding amount m (see FIG. 7B) of the handle body 131 from the outer side surface of the connecting portion 95 may be appropriately selected within a range of about 5 to 10 mm (about 7 mm in the drawing) as long as rotational operability with respect to the operation handle 130 is appropriately maintained.

Raising/Lowering Mechanism

In this example, as illustrated in FIGS. 3 to 6, the raising/lowering mechanism 100 includes a rising/lowering plate 105 as a rising/lowering element that rises and lowers in conjunction with the operation of the operation handle 130. The inner leg portion 90 is raised and lowered following the rising/lowering plate 105.

The raising/lowering mechanism 100 includes the inner leg portion 90 disposed at a lower surface of the rising/lowering plate 105, and an urging spring 120 (in this example, a coil spring is used) as an urging element that urges the inner leg portion 90 toward the rising/lowering plate 105.

The raising/lowering mechanism 100 includes a guide mechanism 125 serving as a guide element that guides the rising/lowering plate 105 so as to rise and lower in a rotation-inhibited state.

Rising/Lowering Plate

In this example, as illustrated in FIGS. 3 to 6, the rising/lowering plate 105 is a plate member made of metal such as SUS, and has a substantially rectangular plate body 106 having substantially the same size as the inner leg portion 90 of the leg part 80. In the plate body 106, bent flange 107 that fall downward are formed on peripheral edges of three sides in the front-rear direction and on the far side in the left-right direction of the apparatus housing 21. A burred portion 110 having a hole diameter into which the tip end side of the shaft pin 135 of the operation handle 130 may be inserted is formed substantially at the center of the plate body 106.

The burred portion 110 referred to herein is formed by forming a hole in the plate body 106 and then forming a flange around the hole to cause a rising flange 111 to protrude upward by flange processing, and further forming an internal thread portion 112 on an inner periphery of the rising flange 111. The internal thread portion 112 may be formed simultaneously with the flange processing, or may be performed after the flange processing.

The external thread portion 113 is formed in a region close to the tip end of the shaft pin 135 of the operation handle 130. The external thread portion 113 is disposed in a state of being screwed into the internal thread portion 112 of the burred portion 110.

In this example, the burred portion 110 is formed at the rising/lowering plate 105; however, it is not limited thereto. A through hole through which the external thread portion 113 of the shaft pin 135 of the operation handle 130 passes may be formed, a nut may be fixed so as to surround the through hole, and the external thread portion 113 of the shaft pin 135 may be screwed into an internal thread portion of the nut.

Figure 6:
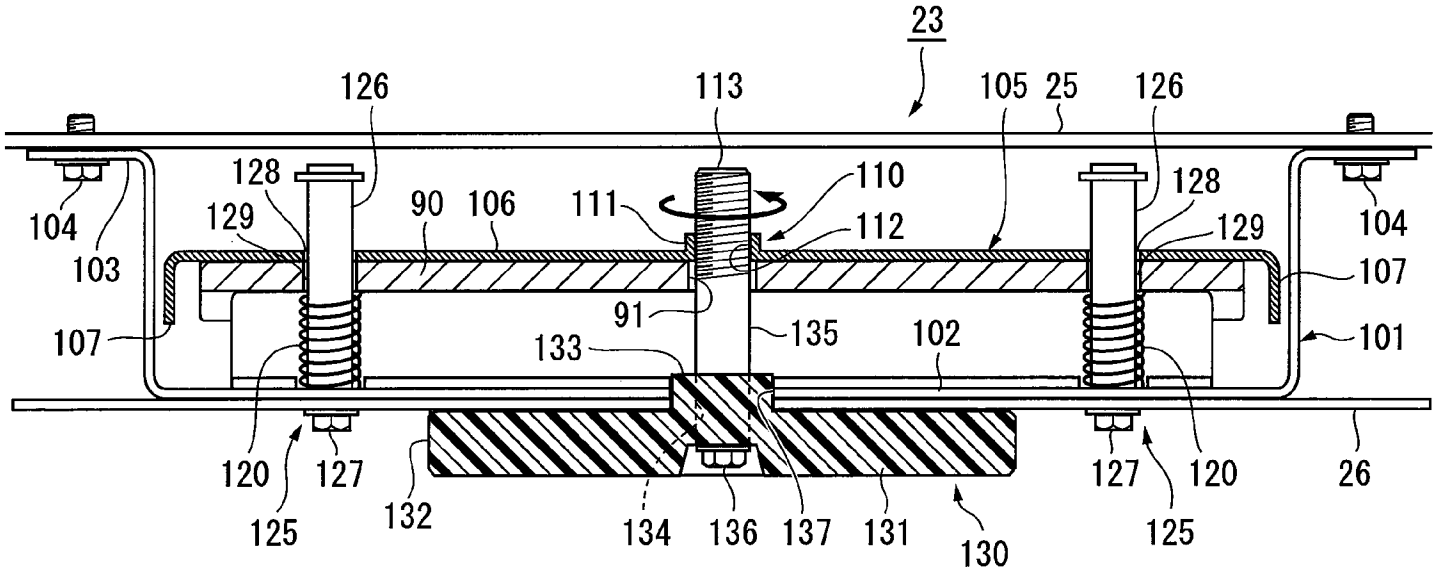
FIG. 6 is an explanatory view illustrating a principle of a raising/lowering movement by a raising/lowering mechanism of the support part.

In this example, the inner leg portion 90 of the leg part 80 is disposed at the lower surface of the rising/lowering plate 105, and a through hole 91 through which the external thread portion 113 of the shaft pin 135 may pass is formed at a position corresponding to the burred portion 110 of the rising/lowering plate 105 as illustrated in FIG. 6.

In this example, the raising/lowering mechanism 100 uses the rising/lowering plate 105. However, for example, an internal thread portion may be formed in the through hole 91 of the inner leg portion 90 without using the rising/lowering plate 105, and the external thread portion 113 of the shaft pin 135 may be screwed into the internal thread portion.

Urging Spring, Guide Mechanism

In this example, as illustrated in FIGS. 3 to 6, the guide mechanism 125 includes a pair of guide pins 126 fixed upward to the bottom wall of the fixing bracket 101 at substantially symmetrical positions with respect to the front-rear direction of the apparatus housing 21 across the holding hole 137 by fasteners 127 such as screws. A pair of guide holes 128 and a pair of guide holes 129 through which the pair of guide pins 126 may pass are formed in the rising/lowering plate 105 and the inner leg portion 90 of the leg part 80. Although fasteners 127 are exposed at the outer surface of the bottom wall 102 of the fixing bracket 101, relief holes 27 for preventing interference with the fasteners 127 are provided in the bottom wall of the frame reinforcing member 26.

Hence, in this example, by inserting the pair of guide pins 126 into the pair of guide holes 128 and the pair of guide holes 129, the rising/lowering plate 105 and the inner leg portion 90 of the leg part 80 are guided so as to rise and lower along the guide pins 126 in a rotation-inhibited state.

In this example, the urging springs 120 are wound around the pair of guide pins 126. The urging springs 120 are interposed in a compressed state between the inner surface of the bottom wall 102 of the fixing bracket 101 and the lower surface of the inner leg portion 90 of the leg part 80. Hence, in this example, the urging springs 120 urge the inner leg portion 90 of the leg part 80 so as to press the inner leg portion 90 toward the rising/lowering plate 105. Thus, when the rising/lowering plate 105 rises and lowers, the inner leg portion 90 of the leg part 80 rises and lowers following the rising/lowering plate 105.

Method of Using Support Part

When Image Forming Apparatus is Installed

Figure 7A:
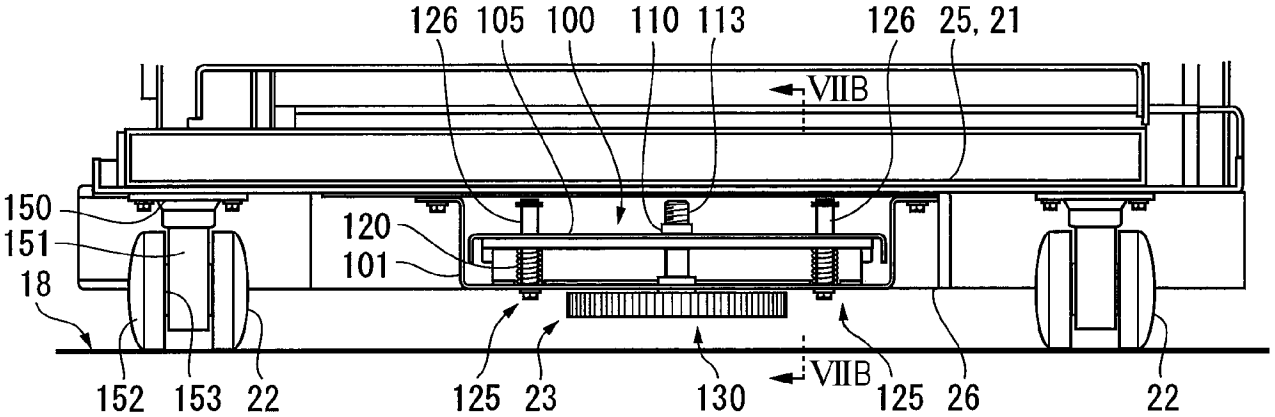
FIG. 7A is an explanatory view illustrating a state when a support part is installed.
Figure 7B:
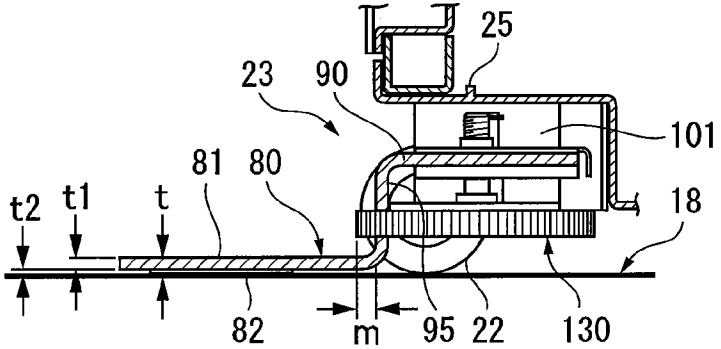
FIG. 7B is an explanatory cross-sectional view taken along line VIIB-VIIB in FIG. 7A.

When the image forming apparatus 20 is installed, as illustrated in FIGS. 7A and 7B, the operation handle 130 of the support part 23 may be rotated in an appropriate direction, and the leg part 80 may be lowered so that the outer leg portion 81 of the leg part 80 is brought into contact with the installation surface 18.

In this example, when the operation handle 130 is rotated in a screwing direction of the external thread portion 113 of the shaft pin 135, the handle body 131 of the operation handle 130 is rotated at the fixed position, and the external thread portion 113 is screwed into the internal thread portion 112 of the burred portion 110. In this state, the rising/lowering plate 105 is pulled downward and lowered against the urging force of the urging spring 120 in accordance with a progress of the screwing operation of the shaft pin 135 of the operation handle 130, and the inner leg portion 90 is lowered against the urging force of the urging spring 120 following the lowering of the rising/lowering plate 105.

At this time, a rotational moment acts on the rising/lowering plate 105 in accordance with a rotational operation of the operation handle 130. However, since the rising/lowering plate 105 is inhibited from rotating by the guide mechanism 125 (the guide pins 126 and the guide holes 128), the rising/lowering plate 105 stably lowers along the guide pins 126. Although the rotation moment from the operation handle 130 does not directly act on the inner leg portion 90 of the leg part 80, the rotation moment indirectly acts on the inner leg portion 90 from a contact portion between the inner leg portion 90 and the rising/lowering plate 105 due to pressure contact therebetween. However, since the inner leg portion 90 of the leg part 80 is inhibited from rotating by the guide mechanism 125 (the guide pins 126 and the guide holes 129), the inner leg portion 90 stably lowers along the guide pins 126.

In this example, the rising/lowering plate 105 has the bent flanges 107 along the three sides of the plate body 106, and the bent flanges 107 are disposed to face each other in a state of being close to both side walls of the fixing bracket 101 and a vertical wall that is a portion of the frame member 25 that constitutes the bottom portion of the apparatus housing 21. Hence, there is no concern that the posture of the rising/lowering plate 105 is inclined when lowering, and the rising/lowering plate 105 lowers in a state in which the posture in the substantially horizontal direction is maintained.

The inner leg portion 90 of the leg part 80 is surrounded by the bent flanges 107 that surround the three sides of the rising/lowering plate 105, and the three sides of the inner leg portion 90 are disposed to face the bent flanges 107 of the rising/lowering plate 105 in a state of being close to the bent flanges 107. Hence, there is no concern that the posture of the inner leg portion 90 is inclined when lowering, and the inner leg portion 90 lowers in a state in which the posture in the substantially horizontal direction is maintained.

In a state in which the leg part 80 is in contact with the installation surface 18, as illustrated in FIGS. 3, 7A, and 7B, the outer leg portion 81 of the leg part 80 is disposed in contact with the installation surface 18 in a state in which the outer leg portion 81 protrudes outward of the outer side surface of the apparatus housing 21.

At this time, a thickness t of the outer leg portion 81 is the sum of a thickness t1 of the metal plate member portion and a thickness t2 of the elastic member 82 on the back surface side. However, the thickness t falls within a range of about 7 to 10 mm, and hence there is a less concern that the outer leg portion 81 obstructs passage.

Figure 9A:
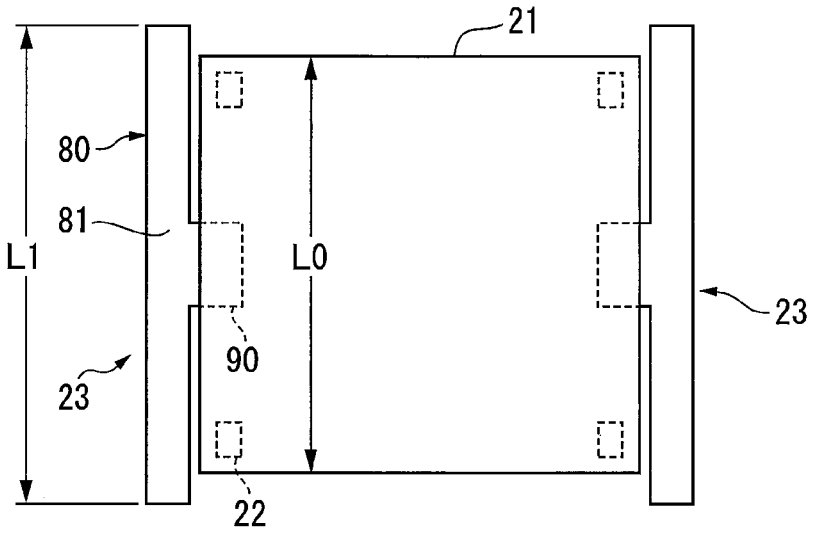
FIG. 9A is an explanatory view schematically illustrating a layout of support parts when the image forming apparatus is viewed from above.

In this example, as illustrated in FIGS. 2A and 9A, since the outer leg portion 81 has the length dimension L1 larger than the length dimension L0 in the front-rear direction of the apparatus housing 21 on each of both sides in the left-right direction of the apparatus housing 21, when it is assumed that a load in a falling down direction acts on the image forming apparatus 20, the load is transferred to the outer leg portion 81 via the inner leg portion 90 and the connecting portion 95. However, since the installation area of the outer leg portion 81 extends in a wide range in the front-rear direction across the position of the center of gravity of the image forming apparatus 20, the load is efficiently distributed.

When Image Forming Apparatus Is Transported

Figure 8A:
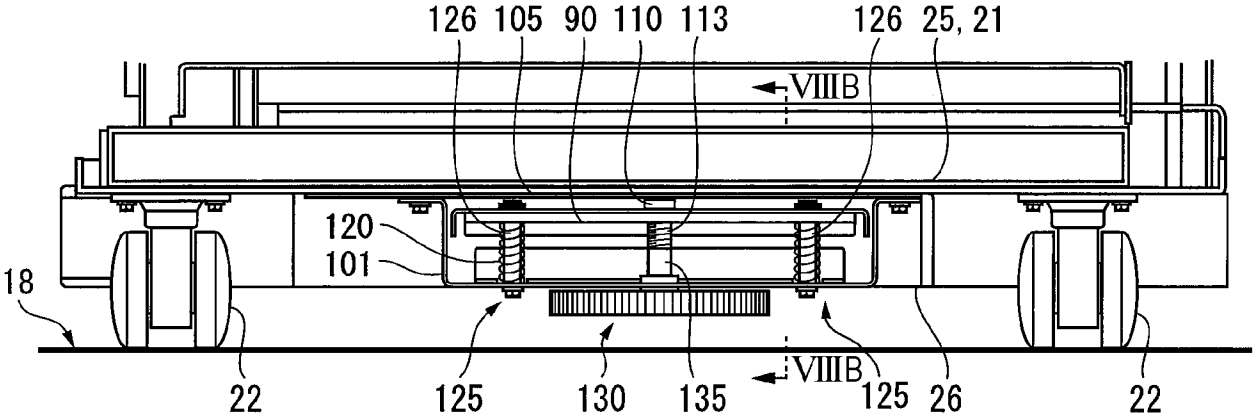
FIG. 8A is an explanatory view illustrating a state in which the support part is retracted upward.
Figure 8B:
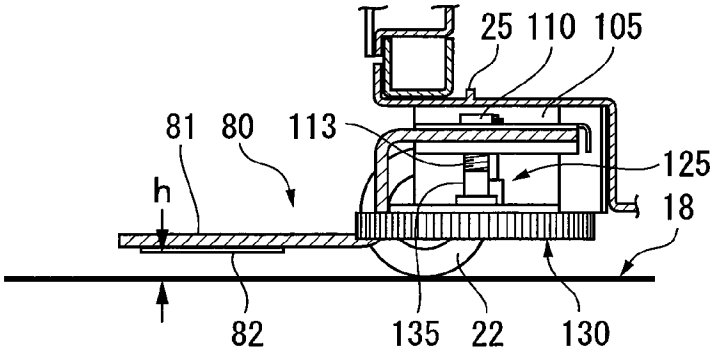
FIG. 8B is an explanatory cross-sectional view taken along line VIIIB-VIIIB.

When the image forming apparatus 20 is transported, as illustrated in FIGS. 8A and 8B, the operation handle 130 of the support part 23 is rotated in an appropriate direction, and the leg part 80 is raised so that the outer leg portion 81 of the leg part 80 is retracted upward from the installation surface 18.

In this example, when the operation handle 130 is rotated in a direction opposite to the screwing direction of the external thread portion 113 of the shaft pin 135, the handle body 131 of the operation handle 130 is rotated at the fixed position, and the external thread portion 113 is screwed out from the internal thread portion 112 of the burred portion 110. In this state, the rising/lowering plate 105 is pulled upward in accordance with a progress of the screwing operation of the shaft pin 135 of the operation handle 130, and the inner leg portion 90 is urged toward the rising/lowering plate 105 by the urging force of the urging spring 120 and rises following the upward movement of the rising/lowering plate 105.

In this example, the raising/lowering range of the leg part 80 by the raising/lowering mechanism 100 depends on the restriction of a location (attached portion) where the raising/lowering mechanism 100 and the operation handle 130 are housed, and a maximum floating amount h of the outer leg portion 81 of the leg part 80 is determined by the raising/lowering range by the raising/lowering mechanism 100.

Figure 5:
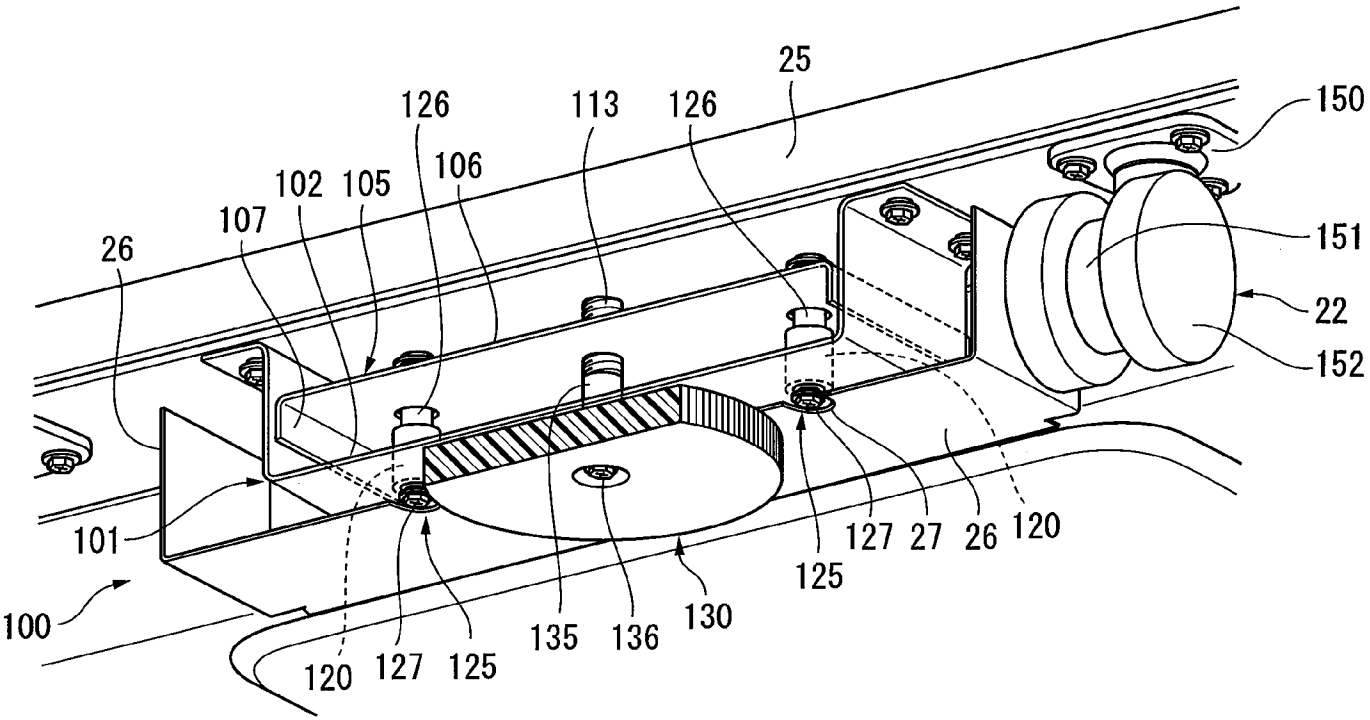
FIG. 5 is an explanatory cross-sectional view taken along line V-V in FIG. 4.

In general, as illustrated in FIGS. 5 and 7A, for example, the caster 22 is configured such that a wheel holder 151 is rotatably provided at an attachment plate 150 fixed to each of four corners of the frame member 25 that constitutes the bottom portion of the apparatus housing 21, and an axle 153 of a wheel 152 is rotatably held by the wheel holder 151.

In a case where the image forming apparatus 20 is transported by the caster 22, it is desirable that the maximum floating amount h of the leg part 80 exceeds the height from the installation surface 18 to the center of the wheel 152 of the caster 22 (corresponding to the center of the caster diameter) from the viewpoint of maximizing transportability by the caster 22. When the maximum floating amount h of the leg part 80 is not sufficiently secured, in a case where an obstacle (not illustrated) is present on the installation surface 18, if the height dimension of the obstacle is smaller than or equal to the caster diameter, the caster 22 may climb over the obstacle. However, the leg part 80 having the small maximum floating amount h abuts on the obstacle and there is a concern that transportability of the image forming apparatus 20 by the caster 22 may be degraded.

A rotation inhibiting movement and an inclination suppressing movement of the posture of the rising/lowering plate 105 and the inner leg portion 90 of the leg part 80 are substantially the same as those when the image forming apparatus 20 is installed.

The support part according to the first exemplary embodiment has been described. However, it is not limited thereto, and may be appropriately changed to aspects presented in first to third modifications as described below.

First Modification

Figure 9B:
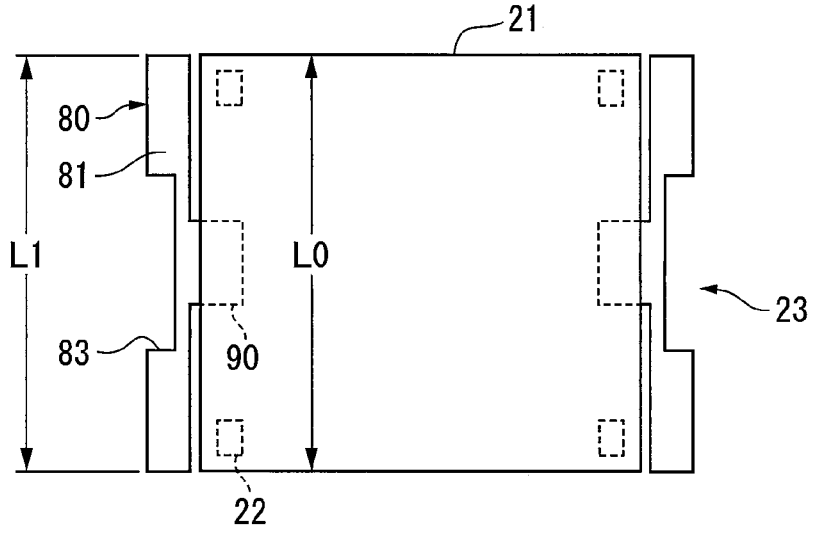
FIGS. 9B and 9C are explanatory views schematically illustrating layouts of support parts according to first and second modifications.

Support parts 23 illustrated in FIG. 9B are provided on both left and right sides of the apparatus housing 21, and outer leg portions 81 extend in the front-rear direction of the apparatus housing 21 in substantially the same manner as in the first exemplary embodiment. However, the length dimension L1 and shape of the outer leg portions 81 are different from those in the first exemplary embodiment. The same components as those in the first exemplary embodiment are denoted by the same reference numerals, and the description thereof will be omitted.

In this example, the outer leg portions 81 have a length dimension L1 similar to a length dimension L0 in the front-rear direction along the outer side surfaces on both left and right sides of the apparatus housing 21, and each have a notch 83 formed in a portion of one side edge so that the width-direction dimension is narrower than other portions in the vicinity of the inner leg portion 90 and the connecting portion 95.

In an aspect in which the support parts 23 are provided on both left and right sides of the apparatus housing 21, the outer leg portions 81 of the first exemplary embodiment may be provided with wraparound portions that each wrap around to the near side or the far side (rear side) of the apparatus housing 21 at the four corners of the apparatus housing 21.

Second Modification

Figure 9C:
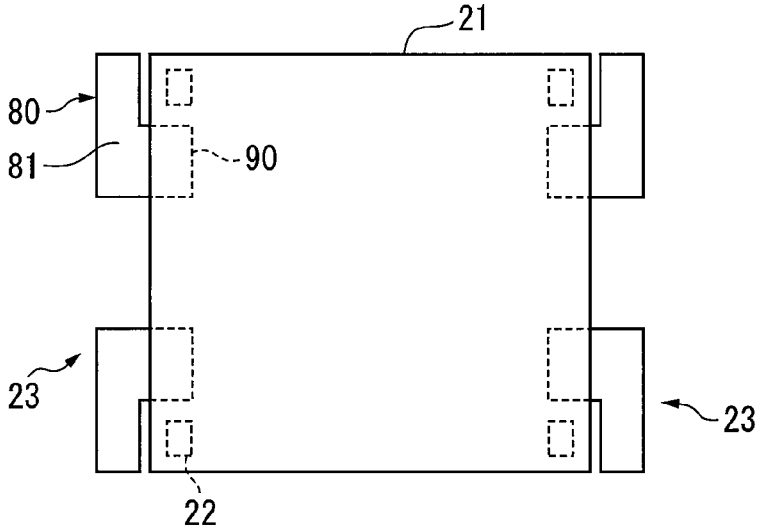

Support parts 23 illustrated in FIG. 9C are provided at the four corners on both left and right sides of the apparatus housing 21 unlike the first exemplary embodiment, and support inner leg portions 90 at the four corners of the bottom portion of the apparatus housing 21 at positions different from the positions of the casters 22 of the apparatus housing 21 so as to raise and lower the inner leg portions 90, and outer leg portions 81 protrude outward from the outer side surface of the apparatus housing 21 via connecting portions 95.

According to this example, four-point support is provided also for the support parts 23.

Third Modification

Figure 10:
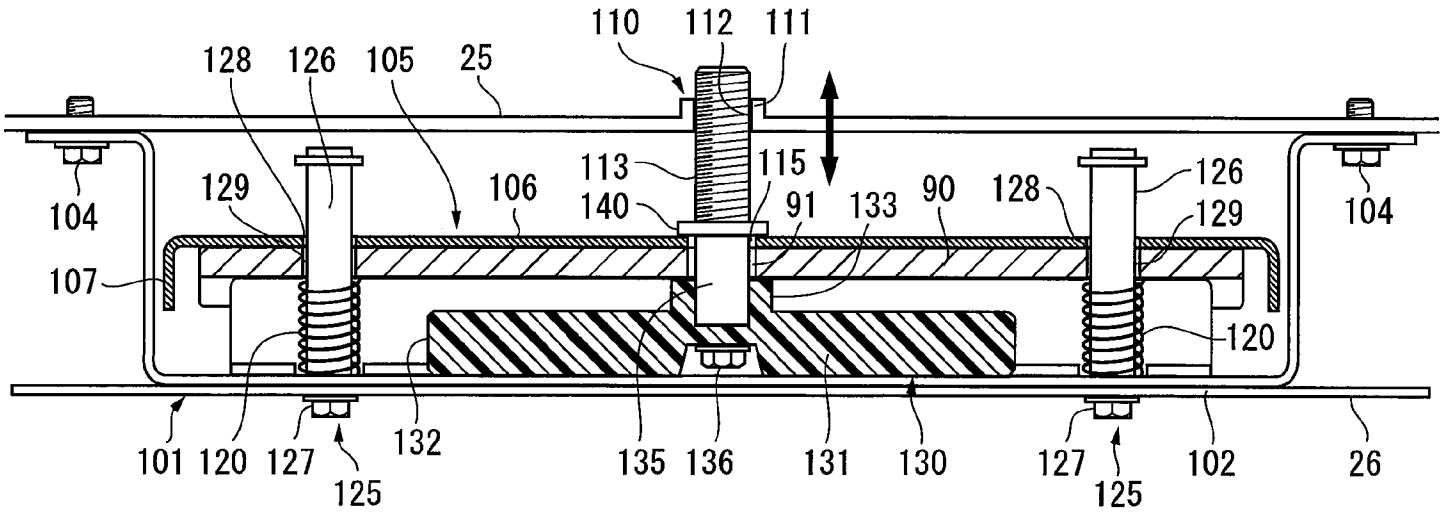
FIG. 10 is an explanatory view illustrating a principle of a raising/lowering movement of a support part according to a third modification.

FIG. 10 illustrates a characteristic portion of a support part according to a third modification.

In this example, a support part 23 is provided with a raising/lowering mechanism 100 in which an operation handle 130 is raised and lowered together with a rising/lowering plate 105.

In this example, a basic configuration of each support part 23 is substantially similar to that of the first exemplary embodiment; however, unlike the first exemplary embodiment, an operation handle 130 is disposed in a fixing bracket 101, a burred portion 110 is formed at a frame member 25 that constitutes a bottom portion of an apparatus housing 21, an external thread portion 113 of a shaft pin 135 of the operation handle 130 is screwed into the burred portion 110, a through hole 115 through which the shaft pin 135 passes is formed in a rising/lowering plate 105 instead of the burring portion 110, and a stopper ring 140 is inserted into a stepped portion 133 of the operation handle 130 and a portion other than the external thread portion 113 of the shaft pin 135 so that the rising/lowering plate 105 and an inner leg portion 90 of a leg part 80 are sandwiched between the stepped portion 133 and the stopper ring 140. The urging spring 120 and the guide mechanism 125 are similar to those of the first exemplary embodiment.

According to this example, when the operation handle 130 is rotated in an appropriate direction, the external thread portion 113 of the shaft pin 135 is screwed into the burred portion 110 of the frame member 25. At this time, assuming that the shaft pin 135 is pulled into the burred portion 110 by a screwing operation of the shaft pin 135, the stopper ring 140 of the shaft pin 135 moves upward, and the operation handle 130 also rises in accordance with the movement of the shaft pin 135. Hence, the rising/lowering plate 105 and the inner leg portion 90 of the leg part 80 rise by the rising of the operation handle 130 and the urging force of the urging spring 120.

In contrast, when the operation handle 130 is rotated in the reverse direction, the external thread portion 113 of the shaft pin 135 is screwed in a direction of being pulled out from the burred portion 110 (downward). At this time, assuming that the shaft pin 135 is pulled out from the burred portion 110 by a screwing operation of the shaft pin 135, the stopper ring 140 of the shaft pin 135 moves downward, and the operation handle 130 also lowers in accordance with the movement of the shaft pin 135. Hence, the rising/lowering plate 105 and the inner leg portion 90 of the leg part 80 lower by the lowering of the operation handle 130 against the urging force of the urging spring 120.

As described above, in this example, the rising/lowering plate 105 and the operation handle 130 rise and lower in accordance with a rotational operation of the operation handle 130, and the inner leg portion 90 of the leg part 80 rises and lowers accordingly.

First Comparison Example

Figure 11A:
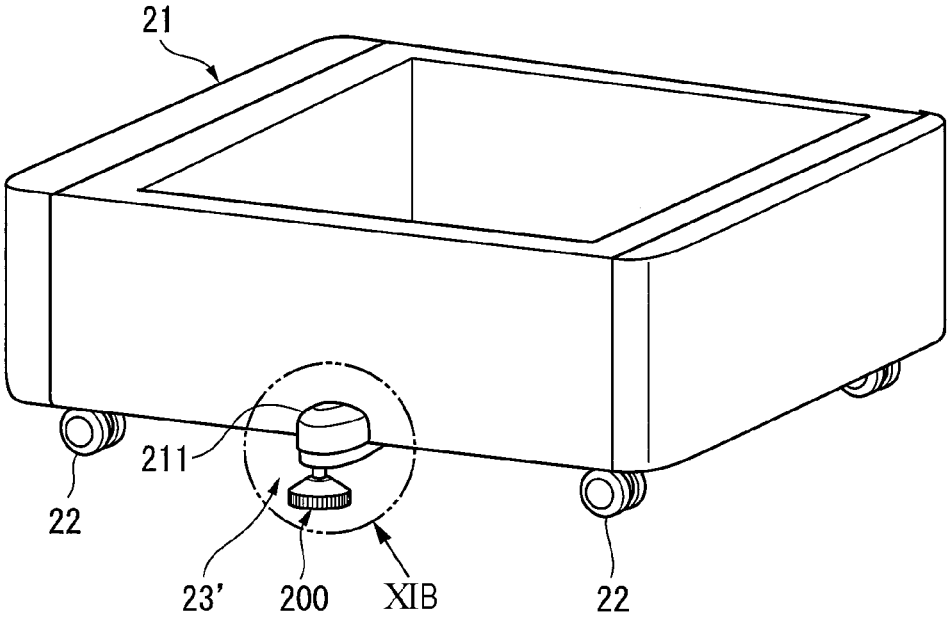
FIG. 11A is an explanatory view illustrating an outline of a support part according to a first comparative example.

FIG. 11A illustrates a support part 23' according to a first comparative example.

In the drawing, the support part 23' is provided at a bottom portion of an apparatus housing 21, and is disposed in a state in which the entire support part 23' protrudes outward from an outer side surface of the apparatus housing 21.

Figure 11B:
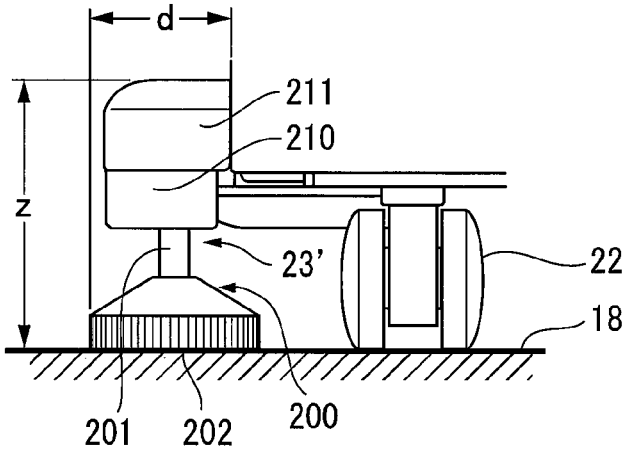
FIG. 11B is a detailed view of part XIB in FIG. 11A.

In this example, as illustrated in FIGS. 11A and 11B, the support part 23' includes an adjuster foot 200 as a leg part for height adjustment, and a receiving part 210 that receives and supports the adjuster foot 200.

In the adjuster foot 200, an external thread portion (not illustrated) is formed in substantially the entire region of a rod 201 extending in the height direction, and a base portion 202 having an outer diameter larger than that of the external thread portion of the rod 201 is provided at a lower end portion of the rod 201.

In this example, the rod 201 may be appropriately selected as long as the rod 201 is made of a metal having high bending strength and having good workability for threading. For example, a steel use machinability (SUM) material having high workability for threading than that of a steel material is used.

The receiving part 210 is configured such that a support bracket is attached to a frame member (not illustrated) that constitutes a bottom portion of the apparatus housing 21, a through hole through which the external thread portion of the rod 201 passes is provided in the support bracket, a nut into which the external thread portion is screwed is fixed, and the external thread portion of the rod 201 is screwed into an internal thread portion of the nut.

Since the receiving part 210 of this example has a structure in which the support bracket is attached to a portion of the frame member, the periphery of the receiving part 210 is covered with a blindfold covering 211 that is separate from an exterior covering of the apparatus housing 21 in order to maintain quality of appearance.

According to this example, the adjuster foot 200 may be raised and lowered by rotationally operating the base portion 202 of the adjuster foot 200. As illustrated in FIG. 11B, the support part 23' is disposed so as to protrude entirely by a height z (about 100 mm) and a protruding amount d (about 50 mm) from the outer side surface of the apparatus housing 21. Hence, the support part 23' likely obstructs during passage, and for attachment work of the support part 23', the blindfold covering 211 is required to be removed once. Hence, there is a concern that workability for attachment of the support part 23' may be degraded.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A support part that supports a lower portion of a housing upon installation of an item on an installation surface, comprising:

a leg part including an outer leg portion, an inner leg portion, and a connecting portion, the outer leg portion being provided so as to come into contact with the installation surface and extending from a gap between the lower portion of the housing and the installation surface so as to protrude outward of an outer side surface of the housing, the inner leg portion being disposed above the outer leg portion and extending inward of the outer side surface of the housing, the connecting portion connecting the outer leg portion and the inner leg portion inside the outer side surface of the housing;

a raising/lowering section that is provided at the lower portion of the housing and that supports the inner leg portion of the leg part so as to raise and lower the inner leg portion; and an operation section that is provided so that a portion of the operation section protrudes outward of an outer side surface of the connecting portion of the leg part and that operates a raising/lowering movement of the raising/lowering section.

2. The support part according to claim 1, wherein a length dimension of the outer leg portion in a direction along the outer side surface of the housing is larger than a length dimension of the inner leg portion in the direction along the outer side surface of the housing.

3. The support part according to claim 1, wherein a length dimension of the outer leg portion in a direction along the outer side surface of the housing is larger than or equal to a horizontal-direction dimension of the outer side surface of the housing.

4. The support part according to claim 2, wherein the length dimension of the outer leg portion in the direction along the outer side surface of the housing is larger than or equal to a horizontal-direction dimension of the outer side surface of the housing.

5. The support part according to claim 1, wherein the outer leg portion includes a plate-shaped elastic member on a bottom surface of the outer leg portion.

6. The support part according to claim 1, wherein the leg part is formed by bending a metal plate member to form the outer leg portion, the inner leg portion, and the connecting portion.

7. The support part according to claim 6, wherein a thickness of the leg part is larger than a thickness of a frame member that constitutes the housing.

8. The support part according to claim 7, wherein the connecting portion has an opening through which the portion of the operation section is exposed.

9. The support part according to claim 1, wherein the raising/lowering section includes a rising/lowering element that rises and lowers in conjunction with an operation of the operation section, and raises and lowers the inner leg portion following the rising/lowering element.

10. The support part according to claim 9, wherein the inner leg portion is disposed at a lower surface of the rising/lowering element, and the raising/lowering section includes an urging element that urges the inner leg portion toward the rising/lowering element.

11. The support part according to claim 9, wherein the raising/lowering section includes a guide element that causes the rising/lowering element to rise and lower in a rotation-inhibited state.

12. The support part according to claim 1, wherein the connecting portion has an opening, and wherein the operation section is present both outside and inside the connecting portion across the opening.

13. The support part according to claim 12, wherein the operation section includes an operation portion and a shaft that rotates in accordance with an operation of the operation portion, and wherein the shaft is located inside the connecting portion, an outer periphery of the operation portion is located outside the connecting portion, and the operation section is rotated by operating the outer periphery of the operation portion around the shaft.

14. The support part according to claim 13, wherein the shaft has an external thread portion, and wherein the raising/lowering section has a threaded hole into which the external thread portion is screwed, and includes a rising/lowering element that rises and lowers in conjunction with an operation of the operation section.

15. A housing structure comprising:

a housing; and the support part according to claim 1 provided at the lower portion of the housing.

16. A housing structure comprising:

a housing; and the support part according to claim 2 provided at the lower portion of the housing.

17. The housing structure according to claim 15, comprising:

a plurality of movable casters provided at the lower portion of the housing, wherein the lower portion of the housing at which the support part is provided is different from support points of the plurality of casters.

18. The housing structure according to claim 15, wherein the support part includes a plurality of support parts disposed symmetrically with respect to the housing.

19. An item comprising:

the housing structure according to claim 15; and various item elements mounted on the housing structure.

20. The item according to claim 19, wherein an operation unit for the item elements is provided at an upper portion of the housing, and wherein the support part is provided so as to face a region of the housing other than a region where a user works on the operation unit.

* * * * *